US010725421B2

(12) United States Patent
Saitou

(10) Patent No.: US 10,725,421 B2
(45) Date of Patent: Jul. 28, 2020

(54) IMAGE FORMING APPARATUS WITH AN OPERATING PORTION CONNECTED TO A FRAME OF THE IMAGE FORMING APPARATUS

(71) Applicant: CANON KABUSHIKI KAISHA, Tokyo (JP)

(72) Inventor: Kazuhiro Saitou, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/565,947

(22) Filed: Sep. 10, 2019

(65) Prior Publication Data

US 2020/0081391 A1 Mar. 12, 2020

(30) Foreign Application Priority Data

Sep. 11, 2018 (JP) ..... 2018-169956

(51) Int. Cl.
*G03G 15/00* (2006.01)
*G03G 21/16* (2006.01)

(52) U.S. Cl.
CPC ..... *G03G 15/751* (2013.01); *G03G 21/1619* (2013.01)

(58) Field of Classification Search
CPC ..... G03G 15/5016; G03G 15/751; G03G 21/1619; G03G 21/1671
USPC ..... 399/81, 107, 117
See application file for complete search history.

(56) References Cited

U.S. PATENT DOCUMENTS 7,062,197 B2 * 6/2006 Kunugi ..... G03G 15/5016 399/107
7,937,012 B2 * 5/2011 Kawai et al. ..... G03G 15/5016 399/81
8,676,079 B2 * 3/2014 Nakamura et al. ..... G03G 15/5016 399/81
9,367,026 B2 * 6/2016 Nakashima ..... G03G 21/1619

FOREIGN PATENT DOCUMENTS

JP 2013-228554 A 11/2013

* cited by examiner

*Primary Examiner* — William J Royer
(74) *Attorney, Agent, or Firm* — Venable LLP

(57) ABSTRACT

An image forming apparatus includes a frame structure including first and second frames supporting a photosensitive member, and a third frame extending in the axis direction and connecting the first frame and the second frame with each other; an operating portion for receiving an instruction of a user; a supporting portion rotatably supporting the operating portion; and a connecting portion connecting the supporting portion with the first frame and the third frame, the connecting portion including a first fixed portion fixed to the third frame, a contact portion contacted with the first frame to restrict movement at least in a direction while permitting movement in another direction, and a second fixed portion fixed to the first frame at a position closer to the first fixed portion than to the contact portion.

8 Claims, 12 Drawing Sheets

IMAGE FORMING APPARATUS WITH AN OPERATING PORTION CONNECTED TO A FRAME OF THE IMAGE FORMING APPARATUS

FIELD OF THE INVENTION AND RELATED ART

The present invention relates to an image forming apparatus such as an electrophotographic copier, an electrophotographic printer, and an inkjet printer.

An image forming apparatus is provided with a controlling portion for setting the apparatus in image quality and image formation count. There is disclosed in Japanese Laid-open Patent Application No. 2013-228554, an image forming apparatus structured to pivotally support its controlling portion in order to make it easier for a user to see the controlling portion.

There is no mention in Japanese Laid-open Patent Application No. 2013-228554, about the connection between the supporting portion which pivotally supports the controlling portion, and the frame which supports a photosensitive member (photosensitive members). However, unless the supporting portion and frame are properly connected to each other, it is possible that as the controlling portion is pivotally moved, a substantial amount of force will be transmitted to the frame, and therefore, the frame will become deformed. If the frame is deformed as described above, the image forming apparatus is reduced in the level of accuracy at which the photosensitive members are positioned relative to the other elements of the image forming apparatus, making it possible for the image forming apparatus to reduce in image quality. For example, the image forming apparatus may become nonuniform in the interval between the adjacent two photosensitive members, and therefore, the image forming apparatus may output images which suffer from color deviation. Further, the image forming apparatus may become nonuniform in the distance between its charging portions and photosensitive members, and/or the distance between its exposing portions and photosensitive members, and therefore, the image forming apparatus may output images which suffer from unintended nonuniformity in image density.

The present invention was made in consideration of the issue described above. Thus, the primary object of the present invention is to provide an image forming apparatus which does not suffer from the problem that as the controlling portion of the image forming apparatus is pivotally moved, the frame by which photosensitive members are supported becomes deformed.

SUMMARY OF THE INVENTION

According to an aspect of the present invention, there is provided an image forming apparatus comprising a photosensitive member; a frame structure including a first frame supporting said photosensitive member, a second frame provided opposed to said first frame in a rotational axis direction of said photosensitive member and cooperating with said first frame to support said photosensitive member, and a third frame extending in the rotational axis direction and connecting said first frame and said second frame with each other; an operating portion configured to receive an instruction of a user relating to image formation; a supporting portion supporting said operating portion so as to be rotatable relative to said frame structure; and a connecting portion connecting said supporting portion with said first frame and said third frame, said connecting portion including a first fixed portion fixed to said third frame, a contact portion contacted with said first frame to restrict movement at least in a direction while permitting movement in another direction which is different from the first direction, and a second fixed portion fixed to said first frame at a position closer to said first fixed portion than to said contact portion.

Further features of the present invention will become apparent from the following description of exemplary embodiments with reference to the attached drawings.

DESCRIPTION OF THE EMBODIMENTS

Embodiment 1

<Image Forming Apparatus>

Next, the overall structure of the image forming apparatus in the first embodiment of the present invention is described along with its image forming operation, with reference to appended drawings. By the way, the measurements, materials, and shapes of the structural components of the image forming apparatus, and the positional relationship among the components, etc., which will be described next, are not intended to limit the present invention in scope, unless specifically noted.

The image forming apparatus in this embodiment is an electrophotographic image forming apparatus, which forms an image on a sheet of recording medium, by transferring yellow (Y), magenta (M), cyan (C) and black (K) toner images onto its intermediary transfer belt, and then, transferring the images onto the sheet from the intermediary transfer belt. By the way, in the following description of the image forming apparatus, the members which use toner are given such referential codes that have suffixes Y, M, C and K, one for one. However, they are practically the same in structure and operation, although they are different in the color of the toner they use. Therefore, the suffixes will be ignored unless differentiation is necessary.

Figure 1:
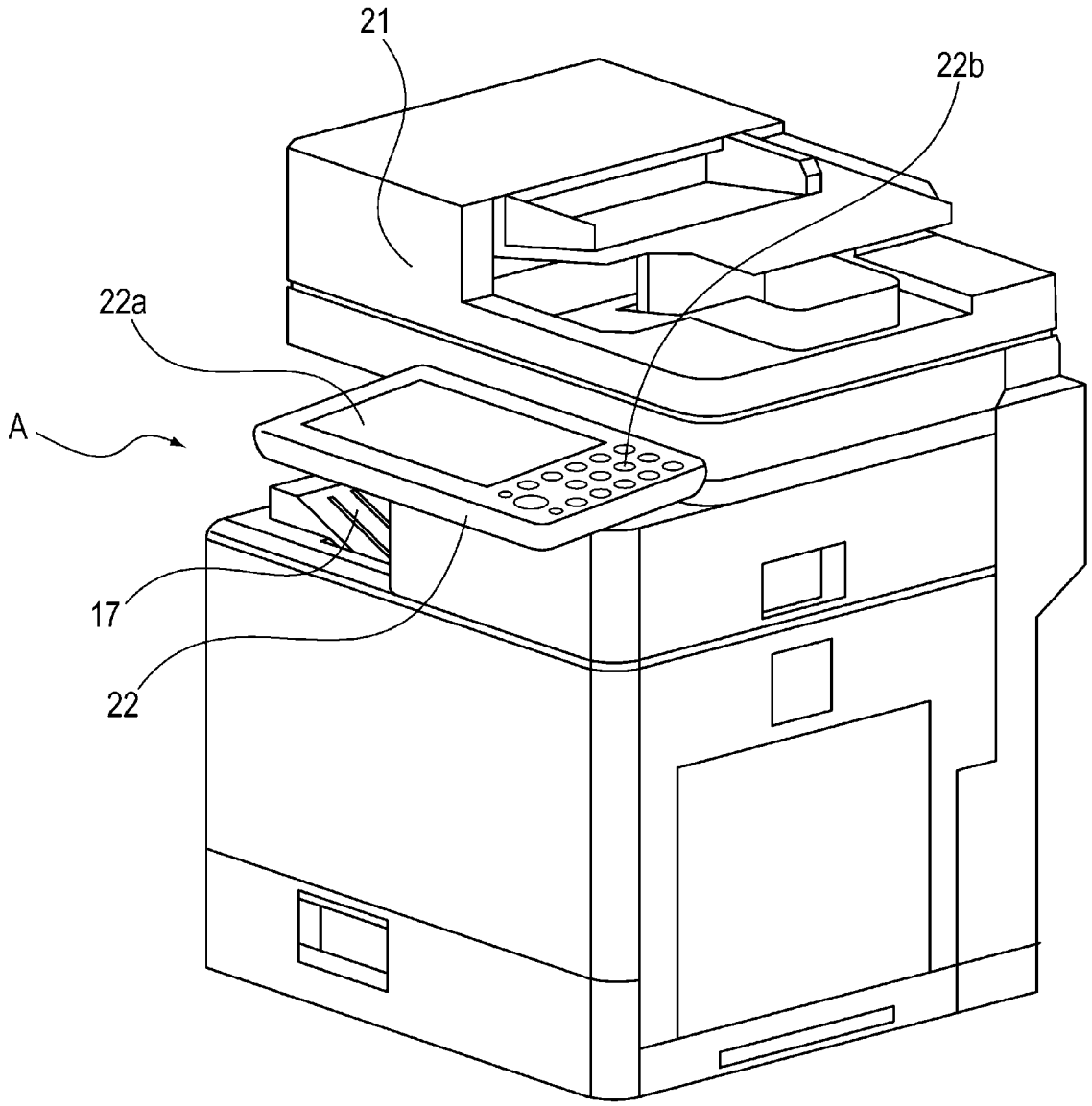
FIG. 1 is a schematic perspective view of a typical image forming apparatus which is in accordance with the present invention.
Figure 2:
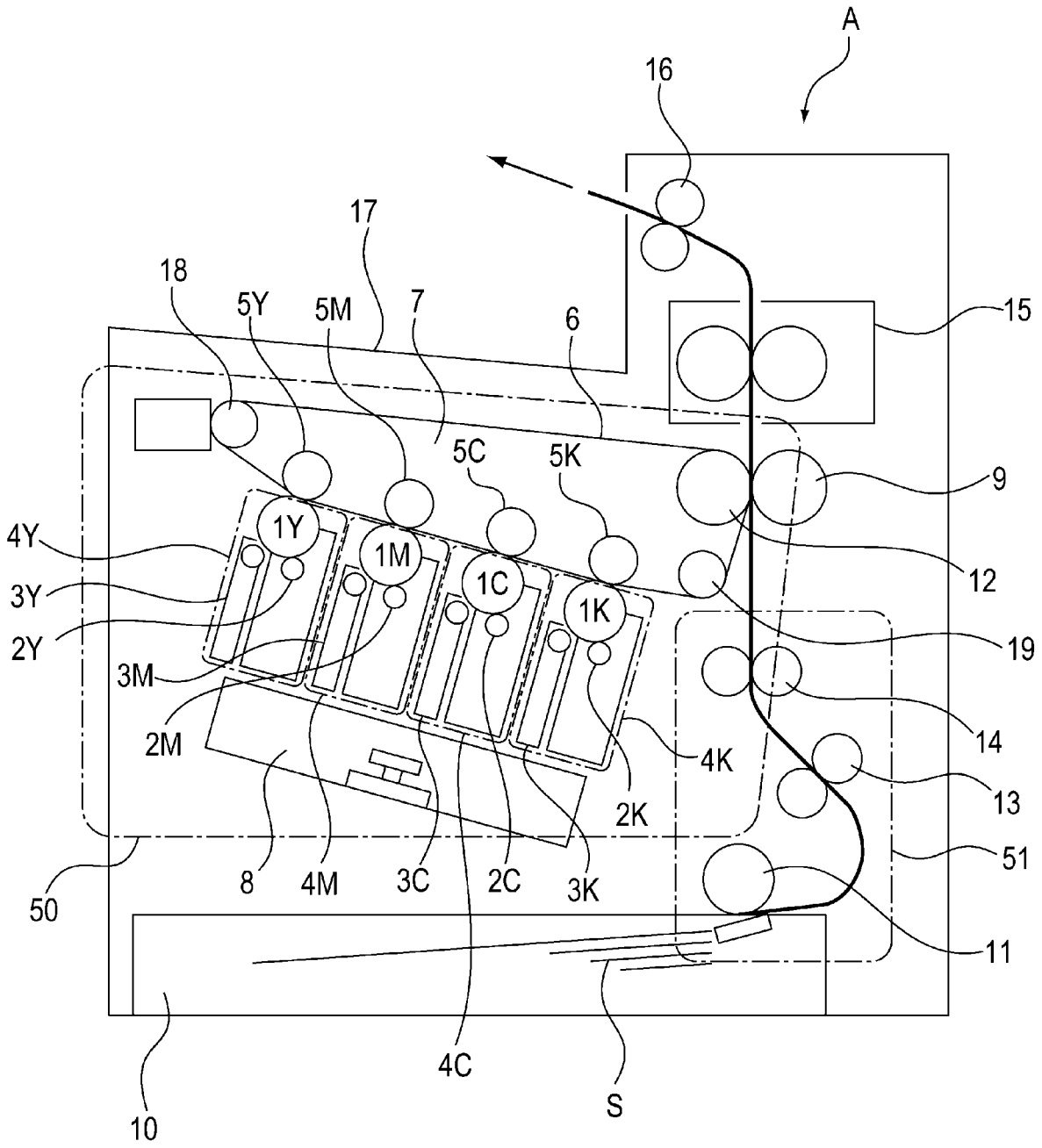
FIG. 2 is a schematic sectional view of the image forming apparatus shown in FIG. 1.

FIG. 1 is a schematic perspective view of an image forming apparatus A. FIG. 2 is a schematic sectional view of the image forming apparatus A. By the way, FIG. 2 does not show a reader 21 nor controlling-displaying portion 22, which will be described later. Referring to FIGS. 1 and 2, the image forming apparatus A has: an image forming portion 50 which forms an image on a sheet of recording medium by transferring toner images onto the sheet; a sheet feeding portion 51 which supplies the image forming portion 50 with sheets of recording medium; and a fixing apparatus 15, that is, a fixing portion which fixes toner images to the sheet. Further, it has: a reader 21 which reads an original; and the controlling-displaying portion 22 which displays information, and makes it possible for an operator to operate (controls) the image forming apparatus A. Here, the control (operation) of the image forming apparatus A means the controls (operations) to be executed to form an image on a sheet of recording medium, and operations to be carried out to read the original with the use of the reader 21, for example.

The image forming portion 50 has: process cartridges 4 (4Y, 4M, 4C and 4K), primary transfer rollers 5 (5Y, 5M, 5C and 5K), a laser scanner unit 8, and an intermediary transfer unit 7. Each process cartridge 4 has a photosensitive drum 1 (1Y, 1M, 1C or 1K), a charge roller 2 (2Y, 2M, 2C or 2K) for charging the peripheral surface of the photosensitive drum 1, a developing apparatus 3 (3Y, 3M, 3C or 3K).

The intermediary transfer unit 7 has an intermediary transfer belt 6, a secondary transfer roller 9, a belt-backing roller 12, an idler roller 19, a tension roller 18, etc. The intermediary transfer belt 6 is an endless belt, and is suspended and tensioned by a combination of the belt-backing roller 12, idler roller 19, and tension roller 18. As the belt-backing roller 12 is rotated by the driving force from a driving force source, the intermediary transfer belt 6 is circularly moved by the rotation of the belt-backing roller 12.

The controlling-displaying portion 22 has a liquid crystal display 22*a* which displays information such as messages to users, etc., and a key board 22*b* having various keys for setting information (numerical values) such as image formation count. The controlling-displaying portion 22 is pivotally supported to ensure that a user can easily see (read) the information on the display 22*a*, regardless of the reflection from illumination, height of user, etc. In this embodiment, by the way, the controlling-displaying portion 22 is made up of the display 22*a*, and key board 22*b* which is independent from the display 22*a*. However, a touch panel or the like, which can function as both the display and key board, may be employed as the controlling-displaying portion 22. As for the structure of the supporting portion which pivotally supports the controlling-displaying portion 22, it is described later in detail.

Next, the image forming operation of the image forming apparatus A is described. As the unshown control portion of the image forming apparatus A receives image formation job signals, sheets S of recording medium stored in layers in a sheet storage 10 begin to be conveyed one by one by a combination of a feed roller 11, conveyance rollers 13, and a pair of registration rollers 14, to the secondary transferring portion formed by the secondary transfer roller 9 and belt-backing roller 12.

Meanwhile, in the image forming portion 50, the peripheral surface of the photosensitive drum 1 is uniformly charged by the charge roller 2. Then, a beam of laser light is projected from the laser scanner unit 8 upon the peripheral surface of each photosensitive drum 1 while being modulated with image data sent from unshown external devices, or the like. Consequently, an electrostatic latent image is effected on the peripheral surface of each photosensitive drum 1.

Thereafter, toner is adhered to the electrostatic latent image on the peripheral surface of the photosensitive drum 1 by the developing apparatus 3. As a result, a toner image is formed on the peripheral surface of the photosensitive drum 1. Then, the toner image on each photosensitive drum 1 is transferred (primary transfer) onto the intermediary transfer belt 6 by the application of bias to the primary transfer roller 5. Consequently, a full-color toner image is effected on the surface of the intermediary transfer belt 6.

Then, the full-color toner image is sent to the secondary transferring portion by the circular movement of the intermediary transfer belt 6. In the secondary transferring portion, the full-color toner image on the intermediary transfer belt 6 is transferred onto the sheet S of recording medium by the application of bias to the secondary transfer roller 9.

After the transfer of the full-color toner image onto the sheet S of recording medium, the sheet S and the toner image thereon are heated and compressed in the fixing apparatus 15. Consequently, the toner image on the sheet S becomes fixed to the sheet S. After the fixation of the full-color toner image to the sheet S, the sheet S is discharged into a delivery portion 17 by a pair of discharge rollers 16.

<Portion for Supporting Controlling-Displaying Portion>

Next, a supporting portion 80 for pivotally supporting the controlling-displaying portion 22 is described about its structure.

Figure 3A:
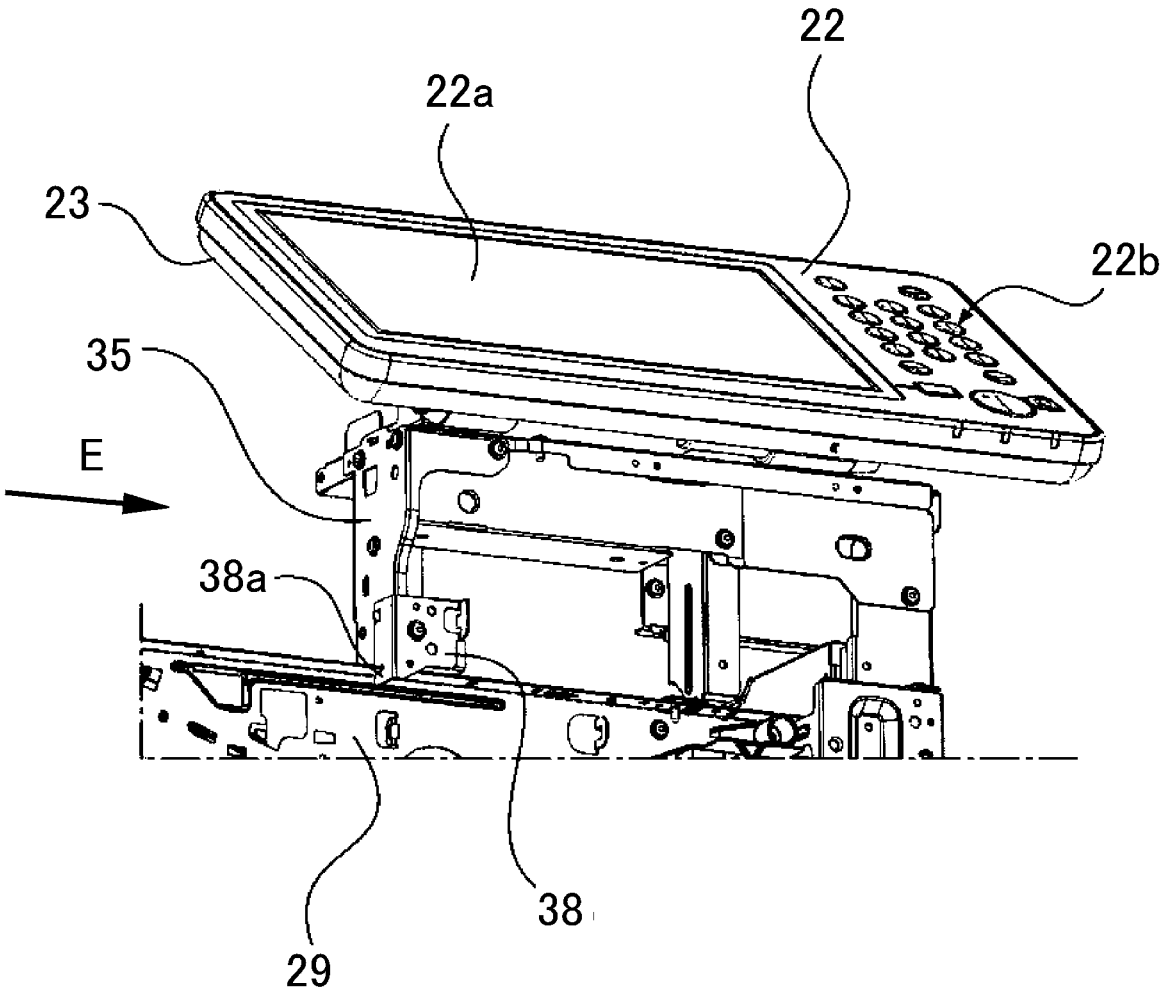
FIG. 3A is a perspective view of a controlling-displaying portion of the image forming apparatus (as seen from front side).
Figure 3B:
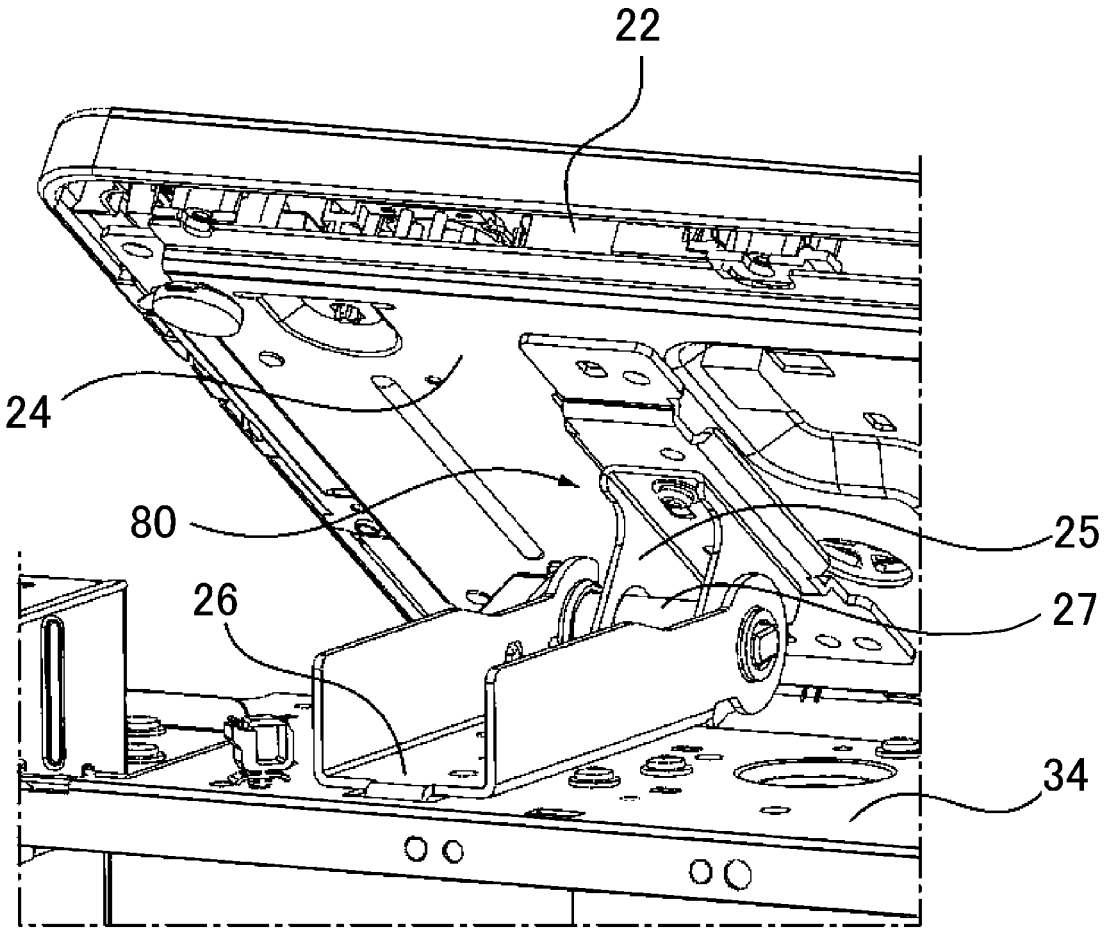
FIG. 3B is a perspective view of the controlling-displaying portion of the image forming apparatus (as seen from rear side).
Figure 4:
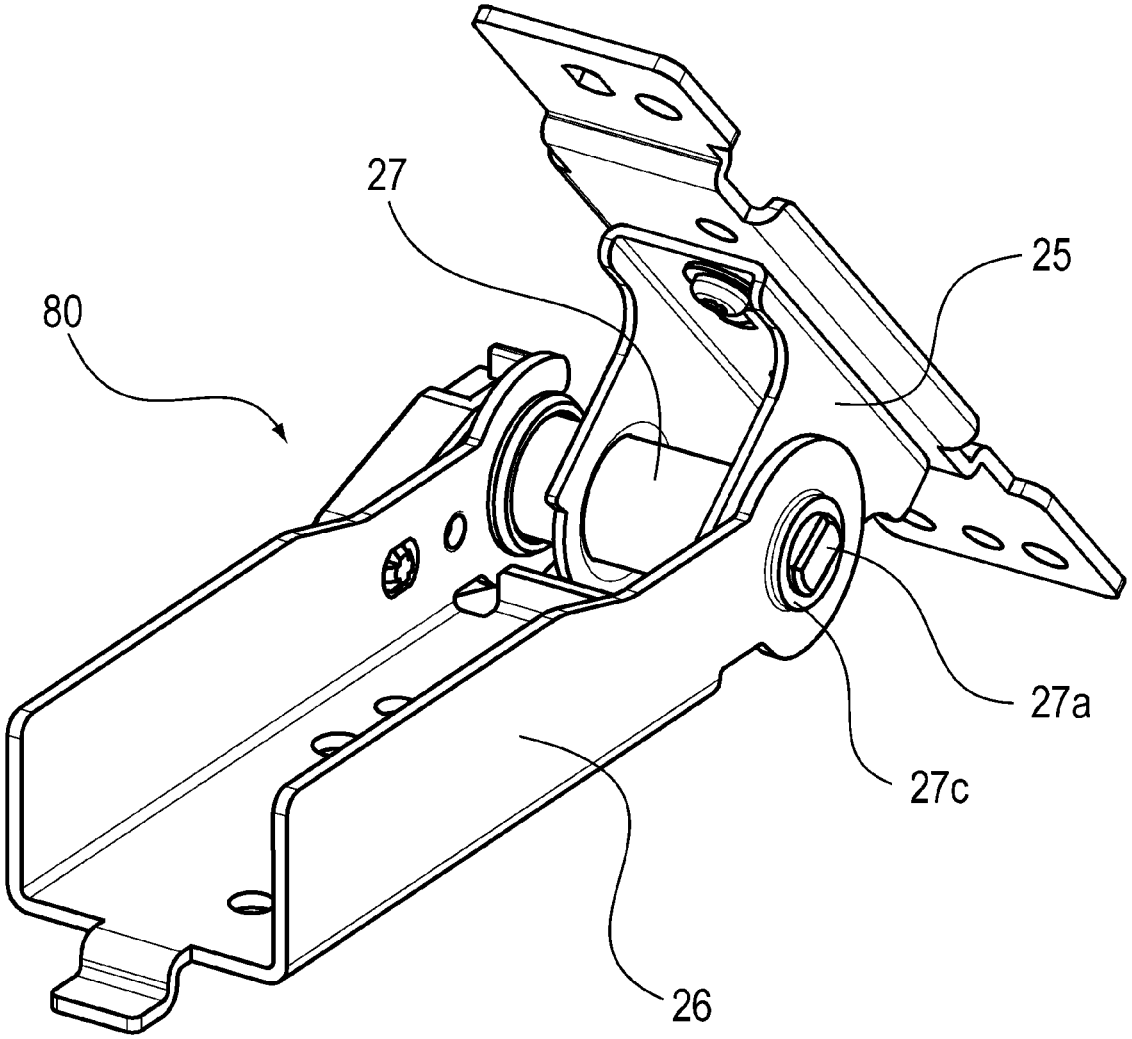
FIG. 4 is a perspective view of a supporting portion which supports the controlling-displaying portion.
Figure 5:
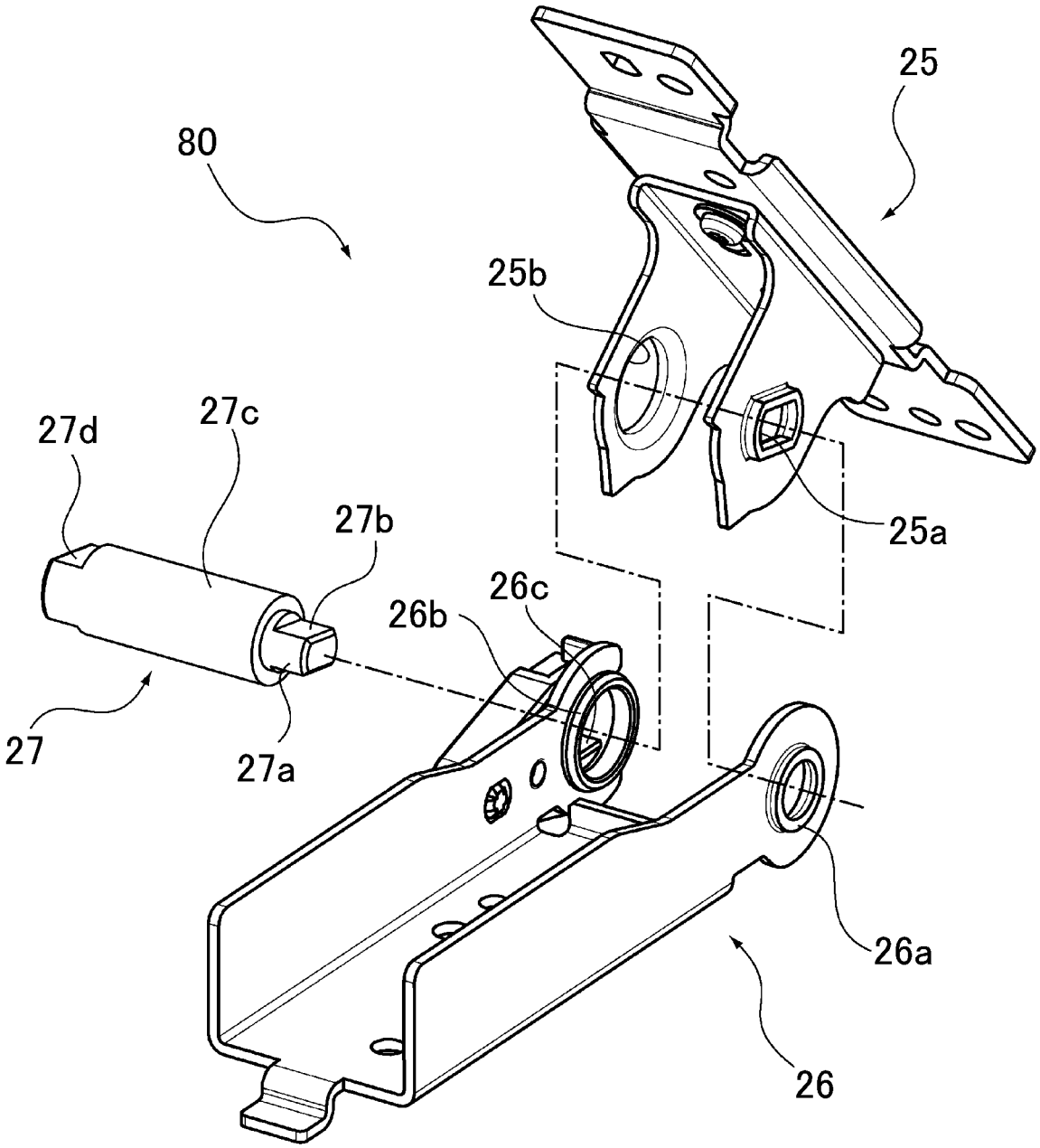
FIG. 5 is an exploded perspective view of the supporting portion which supports the controlling-displaying portion.

FIG. 3A and FIG. 3B are front and rear perspective views, respectively, of the controlling-displaying portion 22. FIGS. 4 and 5 are perspective and exploded perspective views, respectively, of the supporting portion 80 for supporting the controlling-displaying portion 22. By the way, FIGS. 3A and 3B do not show the components which are in the adjacencies of the controlling-displaying portion 22. FIG. 3A is a perspective view of what remains after the removal of a rear cover 23 from the controlling-displaying portion 22.

Figure 8:
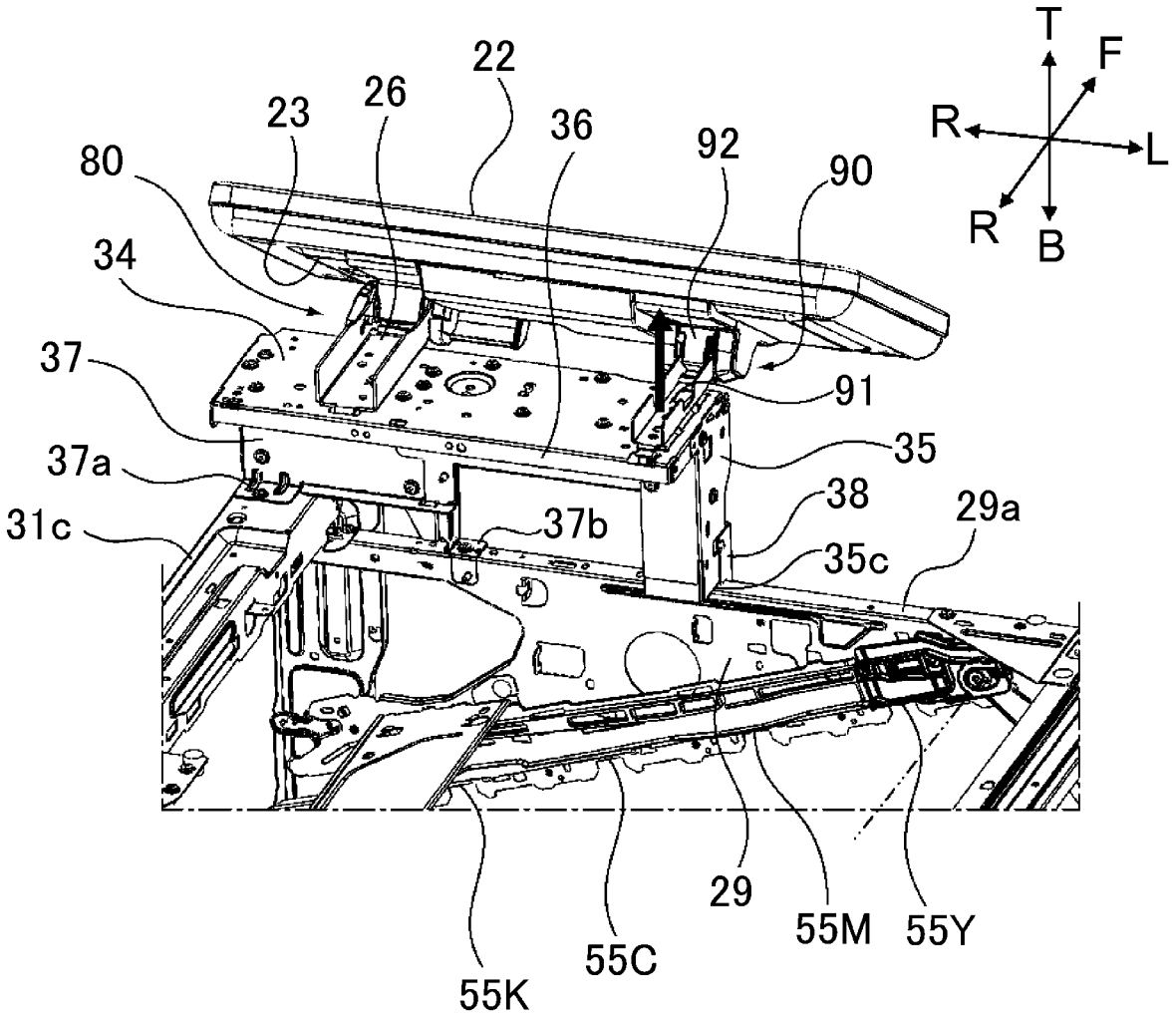
FIG. 8 is a perspective view of the controlling-displaying portion.

Referring to FIGS. 3A-5, the controlling-displaying portion 22 is pivotally supported by a combination of supporting portions 80 and 90 (FIG. 8). The supporting portion 80 is made up of a hinge 25, which is fixed to the rear frame 24 of the controlling-displaying portion 22 with small screws, a free-stop hinge 27 which enables the hinge 25 to be held at a desired angle, and a hinge attachment plate 26. The hinge attachment plate 26 holds the hinge 25 and free-stop hinge 27 together. It is fixed to a top connective plate 34, which is on the main assembly side of the image forming apparatus A, with small screws.

The free-stop hinge 27 is made up of a cylindrical outer shaft 27*c*, and a cylindrical inner shaft 27*a* which fits in the outer shaft 27*c*. One of the lengthwise ends of the inner shaft 27*a* is provided with a flat surface 27*b*, and the corresponding lengthwise end of the outer shaft 27*c* is provided with a flat surface 27*d*. There is friction in the area of contact (interface) between the outer shaft 27*c* and inner shaft 27*a*. Therefore, the controlling-displaying portion 22 can be held at a desired angle by this friction.

The hinge 25 has two holes, more specifically, holes 25*a* and 25*b*, the axial lines of which coincide with the axial line of the controlling-displaying portion 22. The hole 25*b* has a flat surface. In the hole 25*b* having a flat surface, the free-stop hinge 27 fits so that the flat surface of the hole 25*b* remains in contact with the flat surface 27*b* of the free-stop hinge 27, regulating thereby the rotational movement of the inner shaft 27*a* relative to the hinge 25. In the cylindrical hole 25*a*, the cylindrical portion of the outer shaft 27*c* of the free-stop hinge 27 fits. Therefore, the hinge 25 is pivotally supported by the outer shaft 27*c*.

The hinge attachment plate 26 has: a cylindrical hole 26*a*, and a hole 26*b*, the surface of which has a flat portion 26*c*. In the cylindrical hole 26*a*, the cylindrical portion of the inner shaft 27*a* of the free-stop hinge 27 fits. Thus, the inner shaft 27*a* is pivotally supported by the hinge attachment plate 26. In the hole 26*b* having the flat portions, the outer shaft 27*c* of the free-stop hinge 27 fits, whereby the outer shaft 27*c* is regulated in its rotation relative to the hinge attachment plate 26.

The rotational movement of the inner shaft 27*a* relative to the hinge 25 is regulated as described above, regulating thereby the rotational movement of the outer shaft 27*c* relative to the hinge attachment plate 26. On the other hand, the rotation of the inner shaft 27*a* relative to the outer shaft 27*c* is allowed. Thus, the controlling-displaying portion 22 is pivotally movable by the torque applied to the inner shaft 27*a* of the free-stop hinge 27, but, can be held at a desired angle by the friction between the outer shaft 27*c* and inner shaft 27*a*.

<Frame>

Next, the main frame of the image forming apparatus A is described about its structure.

Figure 6A:
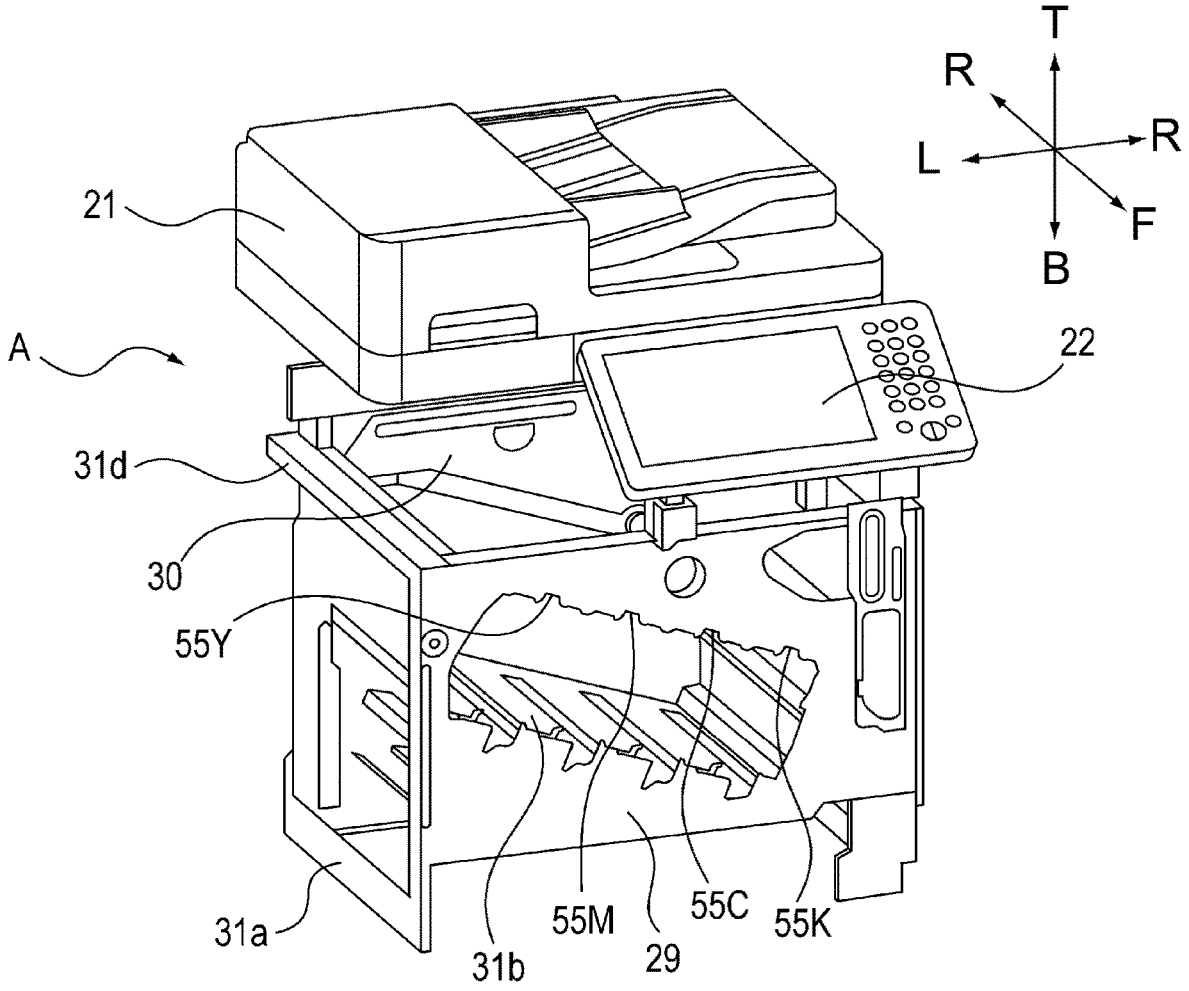
FIG. 6A is a schematic perspective view of a main frame of the image forming apparatus.
Figure 6B:
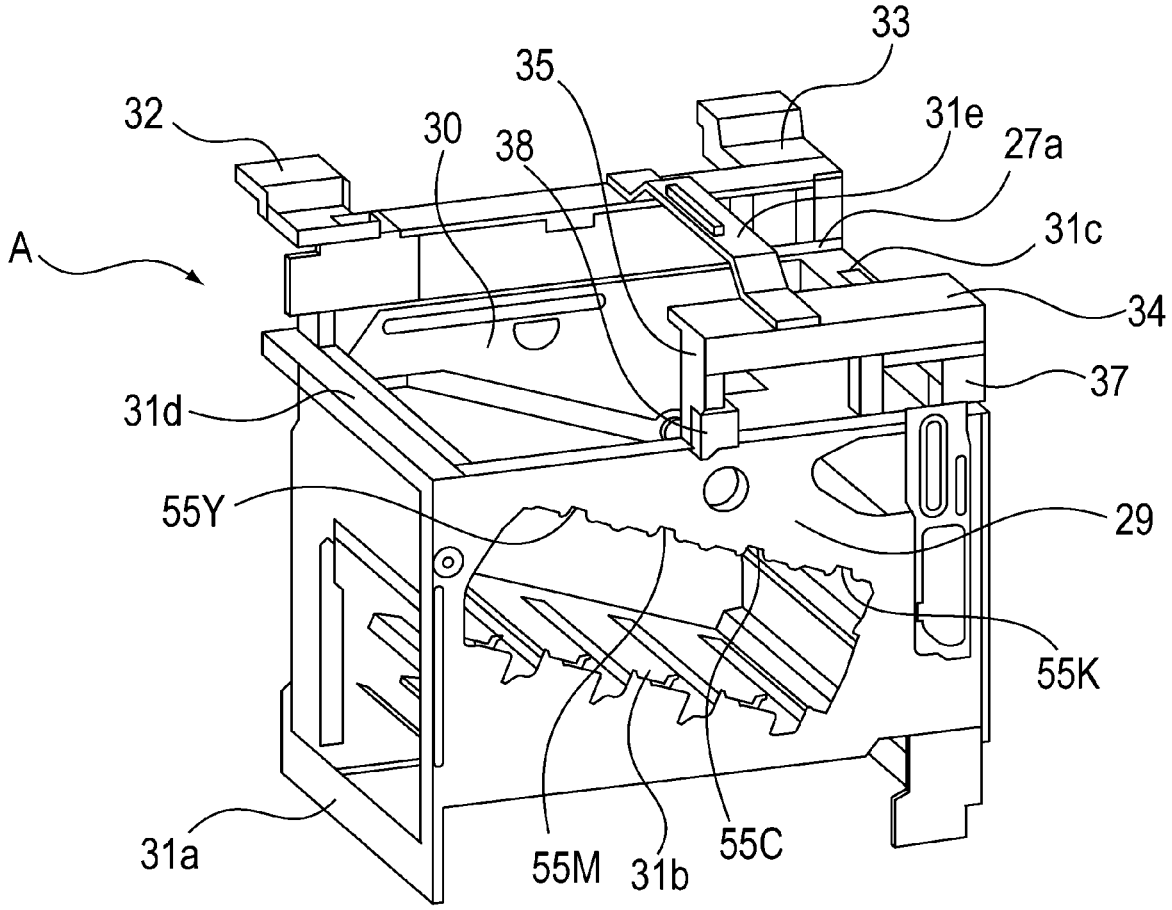
FIG. 6B is a perspective view of the main frame of the image forming apparatus (after the removal of the controlling-displaying portion).
Figure 7:
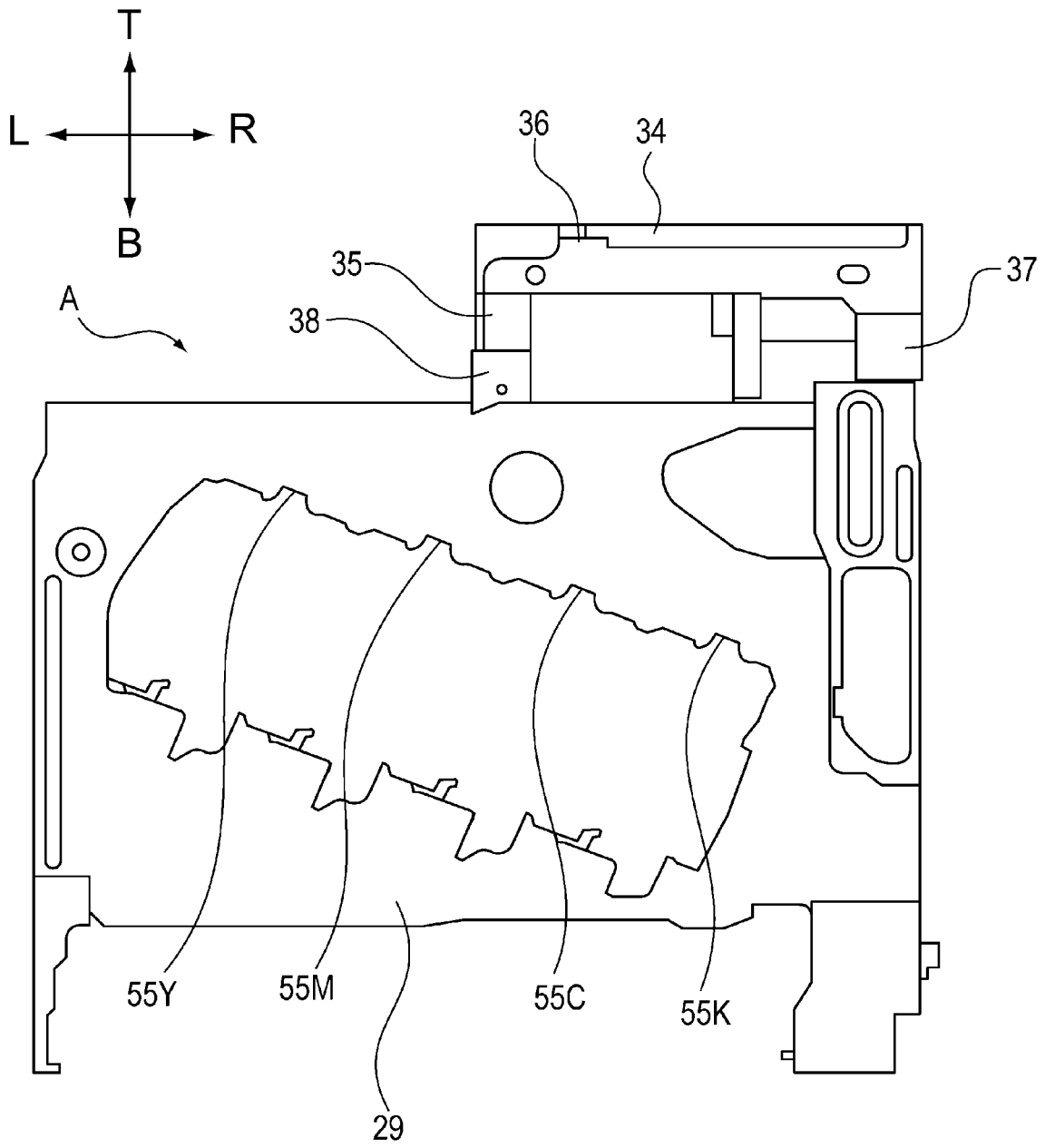
FIG. 7 is a schematic front view of the main frame of the image forming apparatus.

FIG. 6A is a schematic perspective view of the main frame of the image forming apparatus A. FIG. 7 is a schematic front view of the main frame of the image forming apparatus A. Here, FIG. 6A is a schematic perspective view of the main frame of the image forming apparatus A after the attachment of both the reader 21 and controlling-displaying portion 22 to the main frame. FIG. 6B is a schematic perspective view of the main frame of the image forming apparatus A after the removal of both the reader 21 and controlling-displaying portion 22 from the main frame. FIG. 7 is a front view of the main frame of the image forming apparatus A after the removal of both the reader 21 and controlling-displaying portion 22.

Referring to FIGS. 6A, 6B and 7, the main frame of the image forming apparatus A is made up of a front panel 29, a rear panel 30, stays 31*a*-31*e*, and a pair of supporting arms 32 and 33. The front panel 29 (first section) and rear panel 30 (second section) are positioned so that they squarely oppose each other in terms of the front-rear direction (which is parallel to axial line of photosensitive drum 1) of the main assembly of the image forming apparatus A. The stay 31*c* (third section) extends in the direction parallel to the axial line of the photosensitive drum 1, in a manner to bridge between the front and rear panels 29 and 30. The arms 32 and 33 are fixed to the rear panel 30.

By the way, in this embodiment, the front side of the main assembly of the image forming apparatus A is the same side of the image forming apparatus A as the side on which the controlling-displaying portion 22 is. It is the side on which a user stands when the user operates (controls) the image forming apparatus A. The left-right direction of the image forming apparatus A means the left-right direction of the image forming apparatus A when the image forming apparatus A is seen from the front side of the image forming apparatus A. Further, the front-rear direction of the image forming apparatus A means such a direction that is perpendicular to the front and rear panels 29 and 30 of the main frame of the image forming apparatus A. Further, the top-bottom direction coincides with the vertical direction, and means the top-bottom direction as the image forming apparatus A is seen from its front side.

The front panel 29 is provided with positioning portions 55 (55Y, 55M, 55C and 55K), upon which the process cartridges 4 are pressed from the bottom side of the front panel 29 to be precisely positioned. The rear panel 30 also is provided with positioning portions (unshown), which correspond in position to the positioning portions 55, one for one. The process cartridges 4 are highly precisely positioned in the space between the front and rear panels 29 and 30, by being sandwiched between the two panels 29 and 30. That is, the front and rear panels 29 and 30 support the photosensitive drums 1 together by supporting the process cartridges 4 together.

The supporting portion 80 which pivotally supports the controlling-displaying portion 22 is in connection to the front panel 29 and stay 31*c*, by way of a top connective plate 34, a left connective plate 35, a reinforcement plate 36, a right connective plate 37, and a bottom connective plate 38, as will be described later. Further, the reader 21 is fixed to the arms 32 and 33, and top connective plate 34.

<Connection of Control-Display Portion to Main Frame>

Next, the structural arrangement for keeping the controlling-displaying portion 22 connected to the main frame of the image forming apparatus A is described.

Figure 9:
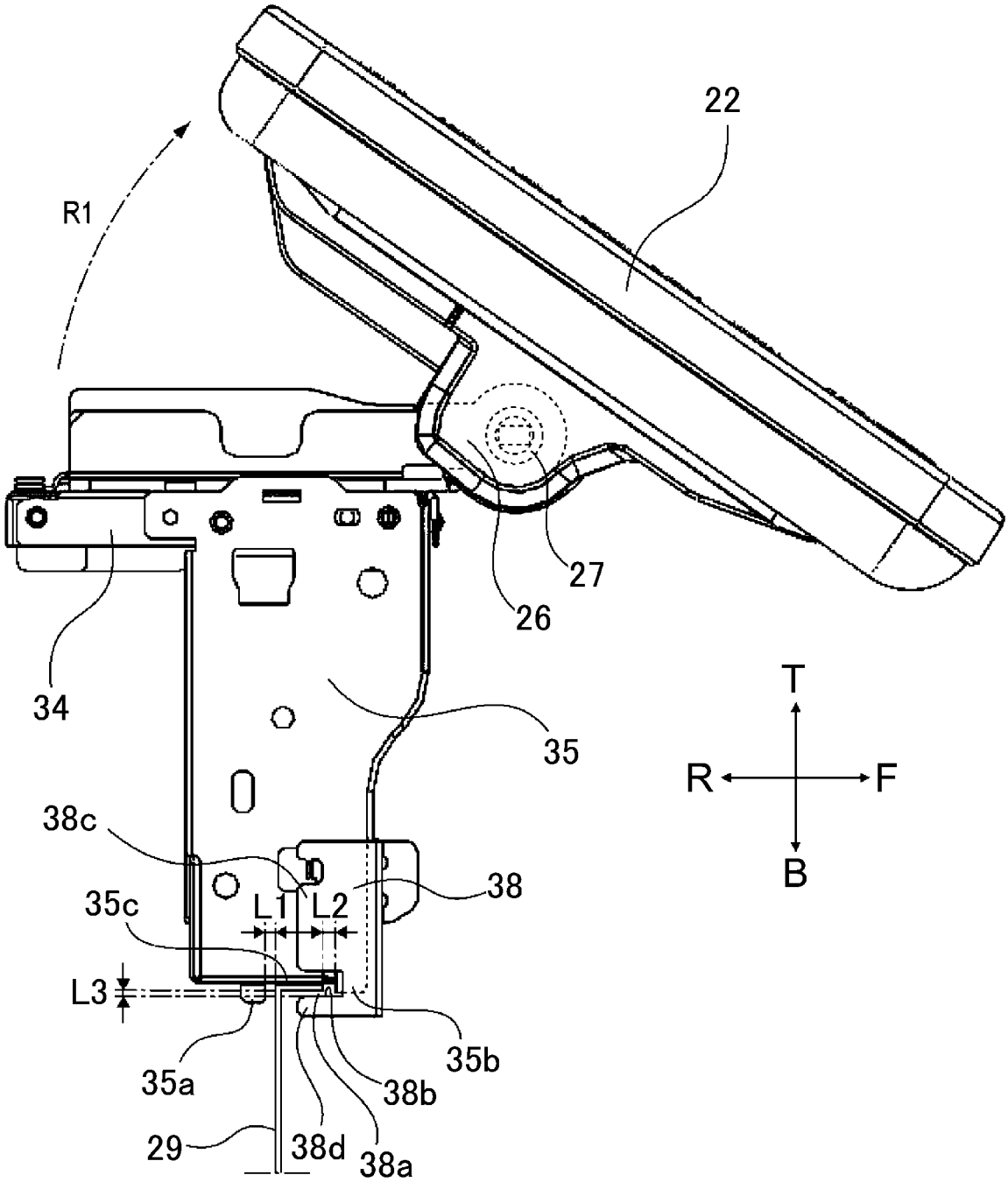
FIG. 9 is a side view of the controlling-displaying portion.

FIG. 8 is a perspective view of the controlling-displaying portion 22 as seen from its rear side. FIG. 9 is a side view of the controlling-displaying portion 22 as seen from the direction indicated by an arrow mark E in FIG. 3A.

Here, the hinge attachment plate 26 is a part of the supporting portion 80 which pivotally supports the controlling-displaying portion 22. A hinge attachment plate 91, to which a hinge 92 is attached, is a part of the supporting portion 90 which pivotally supports the controlling-displaying portion 22. Referring to FIGS. 8 and 9, the hinge attachment plate 26 is in connection to the front panel 29 and stay 32*c* by way of the top connective plate 34, left connective plate 35, reinforcement plate 36, right connective plate 37, and bottom connective plate 38. Further, the hinge attachment plate 91 is in connection to the front panel 29 and stay 31*c* by way of the top connective plate 34, left connective plate 35, reinforcement plate 36, right connective plate 37, and bottom connective plate 38. That is, the top connective plate 34, left connective plate 35, reinforcement plate 36, right connective plate 37, and bottom connective plate 38 are connective portions which connect the combination of the supporting portions 80 and 90, which pivotally support the controlling-displaying portion 22, to the combination of the front panel 29 which is a part of the main frame of the image forming apparatus A, and stay 31*c*. By the way, the controlling-displaying portion 22 pivotally moves as torque is applied to the combination of the supporting portions 80 and 90. However, the supporting portion 80 is greater than the supporting portion 90 in the amount by which torque needs to be applied to pivotally move the controlling-displaying portion 22.

The hinge attachment plate 26 is fixed to the top connective plate 34 with small screws. Further, to the top connective plate 34, the left connective plate 35, reinforcement plate 36, and right connective plate 37 are fixed with small screws. Moreover, to the left connective plate 35, the bottom connective plate 38 is attached with small screws. Further, the left connective plate 35 is in connection to a top surface 29*a* of the front panel 29 by its area of contact (contacting portion 35*c*), being thereby regulated in its downward movement (one direction). Further, the right connective plate 37 is fixed to the stay 32*c* by its first fixation portion 37*a*.

Moreover, it is fixed to the front panel 29 with small screws, by its second fixation portion 37*b*, which is closer to the first fixation portion 37*a* than the contacting portion 35*c* of the left connective plate 35, by which the left connective plate 35 is in connection to the front panel 29. By the way, the contacting portion 35*c* of the left connective plate 35 is not fixed to the front panel 29 with small screws, or welding (being therefore not restricted in movement). Therefore, it is allowed to move relative to the front panel 29 in any direction, except for the downward direction. Further, the supporting portion 80 is positioned between the first fixation point 37*a* and second portions fixation point 37*b* in terms of a left-right direction as shown in FIG. 8.

Moreover, the left connective plate 35 is provided with a pair of protrusions 35*a* and 35*b*, which protrude downward from the two portions of the bottom surface of the left connective plate 35, one for one, which sandwich the contacting portion 35*c* in terms of the front-rear direction. The protrusion 35*b* (second protrusion) is in contact with the contacting portion 35*c*, on the front side, that is, the opposite side from the rear side which has the protrusion 35*a* (first protrusion), in terms of the front-rear direction. The protrusions 35*a* and 35*b* are positioned so that they sandwich the front panel 29, in terms of the front-rear direction of the main assembly of the image forming apparatus A, each holding a certain amount of gap from the front panel 29.

Further, the bottom connective plate 38 is provided with a slit 38*a*, into which the front panel 29 fits. Thus, the bottom connective plate 38 sandwiches the top edge portion of the front panel 29 from the top and bottom sides of the image forming apparatus A, holding a certain amount of gap from the front panel 29. More specifically, the bottom connective plate 38 is provided with a third protrusion 38*c* which protrudes rearward of the main assembly of the image forming apparatus A, from the bottom side of the slit 38*a*, and a fourth protrusion 38*d* which protrudes in the same direction as the third protrusion 38*c*. Thus, the slit 38*a* is between the third protrusion 38*c* and fourth protrusion 38*d*. Further, the third and fourth protrusions 38*c* and 38*d* are positioned so that they sandwich the top edge portion of the front panel 29 from the top and bottom sides, respectively, of the main assembly of the image forming apparatus A. By the way, the left connective plate 35 and bottom connective plate 38 are attached in the following manner: First, the bottom connective plate 38 is attached to the front panel 29 from the top side, and then, the bottom connective plate 38 is attached to the front panel 29 from the front side.

Structuring the image forming apparatus A so that the supporting portion 80 of the controlling-displaying portion 22 is supported by the main frame of the image forming apparatus A as described above provides the following effects. That is, as the controlling-displaying portion 22 is pivotally moved in the direction indicated by the arrow mark R1 in FIG. 9, moment is generated in the hinge attachment plate 26 in the same direction as the pivotal movement of the controlling-displaying portion 22. This moment is primarily transmitted through the top connective plate 34, left connective plate 35, and right connective plate 37, to the front panel 29 which supports the process cartridges 4. Thus, this moment functions as such a force that pushes the front panel 29 frontward.

By the way, the amount of the force which acts on the front panel 29 as the controlling-displaying portion 22 is pivotally moved is proportional to the amount of friction which the free-stop hinge 27 generates. That is, the greater in size, and therefore, heavier, the controlling-displaying portion 22 is, the greater the friction has to be to hold the controlling-displaying portion 22 at a desired angle, and therefore, the greater the amount of force which acts on the front panel 29 as the controlling-displaying portion 22 is pivotally moved. Further, it is possible that forces other than the above-described force will act on the front panel 29. That is, it is possible that such forces that are different in direction and amount will act on the front panel 29, because users (operators) are different in the manner in which they apply force to the controlling-displaying portion 22 to pivotally move the controlling-displaying portion 22; they might drop the image forming apparatus A, subjecting the image forming apparatus A to a substantial amount of impact, while they are transporting the image forming apparatus A.

In a case where the left connective plate 35 is fixed to the front panel 29 with small screws, welding, or the like means, the force which acts on the left connective plate 35 as the controlling-displaying portion 22 is pivotally moved is more likely to be transmitted to the front panel 29 than otherwise. In such a case, if a substantial amount of force acts on the front panel 29 as the controlling-displaying portion 22 is pivotally moved, it is possible that the front panel 29 will be deformed. If the front panel 29 is deformed, it is possible that the image forming apparatus A will be reduced in the level of accuracy at which the process cartridges 4 are supported by the front and rear panels 29 and 30.

In comparison, in this embodiment, the left connective plate 35 is not connected (fixed) to the front panel 29 with small screws, welding, or the like. Instead, the contacting portion 35*c* of the left connective plate 35 is in contact with the top surface 29*a* of the front panel 29 to regulate the downward movement of the left connective plate 35. Further, the left connective plate 35 is not confined (fixed) to the front panel 29 with small screws, welding, or the like, being therefore allowed to move any direction, except for downward, relative to the front panel 29. That is, as force is applied to the left connective plate 35 by the pivotal movement of the controlling-displaying portion 22, the left connective plate 35 is allowed to move in the front-rear direction by an amount equal to the amount of gap (L1 and L2 in FIG. 9) between its protrusions 35*a* and 35*b*. Further, the left connective plate 35 is allowed to move upward by an amount equal to the gap (L3 in FIG. 9) between the bottom connective plate 38 (fourth protrusion 38*d*) and front panel 29, that is, the gap created by the slit 38*a* of the bottom connective plate 38. As described above, in this embodiment, the image forming apparatus A is structured so that the left connective plate 35 and bottom connective plate 38 are allowed to move upward, frontward, and rearward relative to the front panel 29.

In a case where the image forming apparatus A is structured so that the left connective plate 35 and front panel 29 are connected to each other with small screws, welding, or the like, as force acts on the top connective plate 34 in the direction indicated by an arrow mark in FIG. 8, the force will directly act on the front panel 29 in the direction indicated by the arrow mark, by way of the left connective plate 35. In comparison, in a case where an image forming apparatus is structured so that a gap (L3 in FIG. 9) is provided between the left connective plate 35 and front panel 29 as in this embodiment, no force acts on the front panel 29 as long as the amount of the movement of the left connective plate 35 is smaller than the gap L3. Therefore, the image forming apparatus A in this embodiment is smaller in the amount of force transmitted to the front panel 29 as the controlling-displaying portion 22 is pivotally moved, than an image forming apparatus structured so that the left connective plate 35 is attached to the front panel 29 with small screws, welding, or the like.

Further, the right connective plate 37 is fixed to the stay 31*c* at the first fixation point 37*a*, and to the front panel 29 at the second fixation point 37*b* which is closer to the first fixation point 37*a* than the contacting portion 35*c* of the left connective plate 35. Therefore, the force which acts on the right connective plate 37 as the controlling-displaying portion 22 is pivotally moved is dispersed to the front panel 29 and stay 31*c*. Therefore, not only is it possible to firmly connect the supporting portion 80 of the controlling-displaying portion 22, front panel 29, which is a part of the main frame of the image forming apparatus A, and stay 31*c* to each other, but also, to reduce the image forming apparatus A in the amount of force which is transmitted to the front panel 29 as the controlling-displaying portion 22 is pivotally moved.

As described above, according to this embodiment of the present invention, not only is it possible to more firmly connect the supporting portion 80 for supporting the controlling-displaying portion 22 to the main frame of the image forming apparatus A than in the case of any conventional image forming apparatus, but also, to reduce the image forming apparatus in the amount of force which is transmitted to the front panel 29 as the controlling-displaying portion 22 is pivotally moved. Therefore, it is possible to prevent the image forming apparatus A from suffering from the problem that an image forming apparatus is reduced in the level of accuracy at which its process cartridges 4 are positioned, by the deformation of its front panel 29, and therefore, to prevent the image forming apparatus A from being reduced in image quality by the deformation of the front panel 29.

As for the measurement of the gap L1 between the protrusion 35*a* of the left connective plate 35 and front panel 29, and measurement of the gap L2 between the protrusion 35*b* of the left connective plate 35 and front panel 29, they are desired to be set to a value in a range in which the left connective plate 35 is elastically deformable. In this embodiment, they are set to roughly 0.5 mm. Similarly, the measurement of the gap L3 formed between the bottom connective plate 38 and front panel 29 by the slit 38*a* of the bottom connective plate 38 is desired to be set to a value in a range in which the left connective plate 35 is elastically deformable. It this embodiment, it is set to roughly 0.5 mm. Since the image forming apparatus A is structured as described above, as the top connective plate 34 is made to deform by the force which acts on the left connective plate 35 side of the top connective plate 34 in the direction indicated by the arrow mark in FIG. 8, the front panel 29 and the contacting surface 38*b* of the bottom connective plate 38 come into contact with each other, and regulates the deformation of the top connective plate 34. Since the amount of deformation of the top connective plate 34 is kept within the limit of its elasticity, it is possible to prevent the left connective plate 35 from being permanently deformed (plastic deformation). That is, the contacting surface 38*b* is such a surface that comes into contact with the bottom surface of the front panel 29 to prevent the problem that as force acts on the top connective plate 34, the top connective plate 34 is deformed beyond the limit of its elasticity. By the way, the measurements of the gaps L1 and L2 do not need to be 0.5 mm as long as they are in a range in which the top connective plate 34 is allowed to remain elastic.

Further, according to this embodiment, when the controlling-displaying portion 22 is not under the force that is generated as the controlling-displaying portion 22 is pivotally moved, the contacting portion 35*c* is in contact with the top surface 29*a* of the front panel 29. Therefore, it is possible to prevent the controlling-displaying portion 22 from rattling against the main assembly of the image forming apparatus A.

Figure 10:
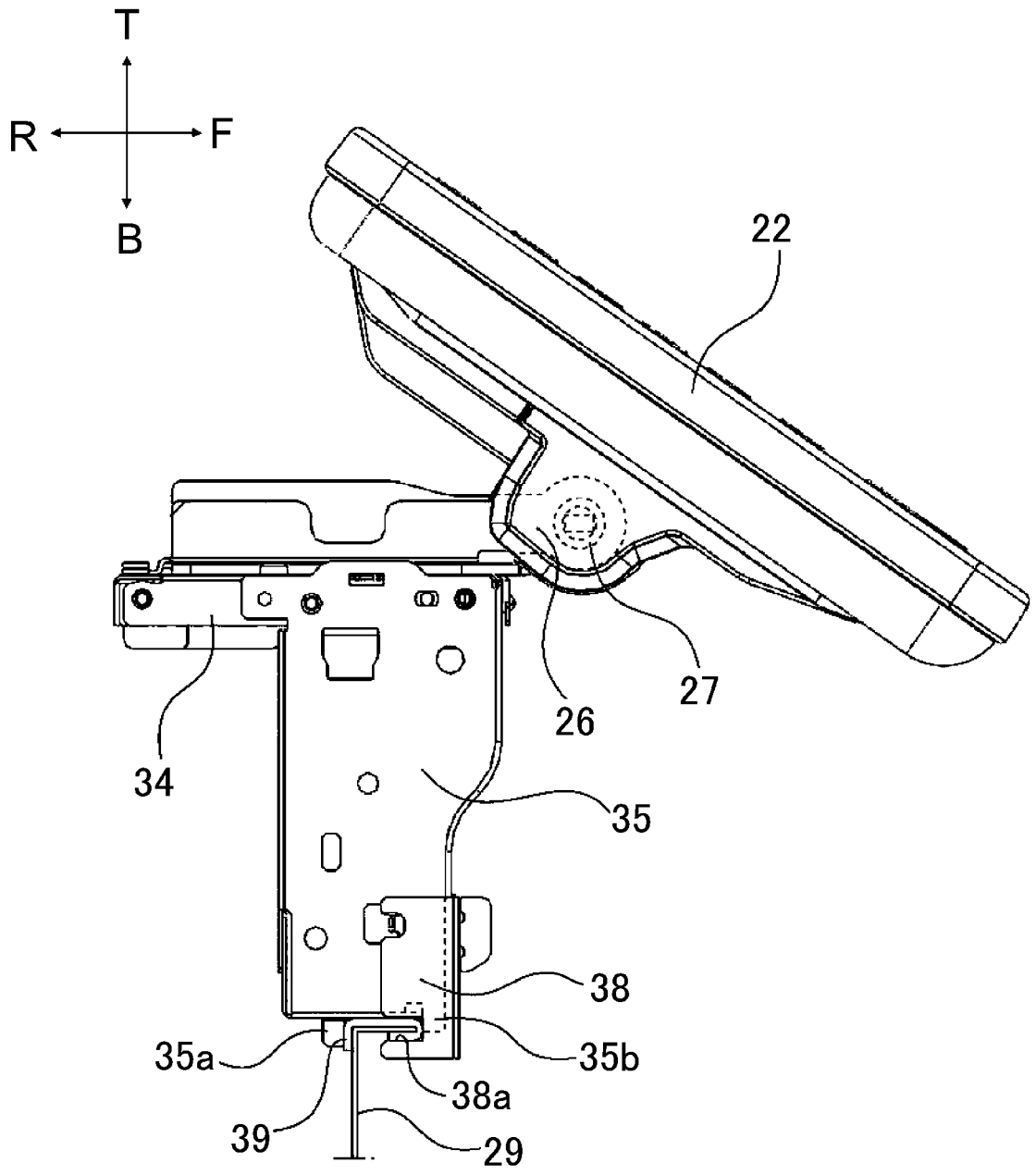
FIG. 10 is a drawing of an image forming apparatus which is different in structure from the one shown in FIG. 1.

By the way, referring to FIG. 10, an elastic member 39 formed of rubber or the like may be placed between the front panel 29 and left connective plate 35, and between the bottom connective plate 38 and front panel 29. With the placement of the elastic member 39 as described above, it is possible to absorb the force which is generated as the controlling-displaying portion 22 is pivotally moved, by the elastic deformation of the elastic member 39, to reduce the amount of force which acts on the front panel 29 by way of the left connective plate 35 and bottom connective plate 38. Therefore, the front panel 29 is less likely to be deformed, making it less likely for the image forming apparatus A to suffer from the problem that the image forming apparatus A is reduced in image quality by the afore-mentioned deformation of the front panel 29. Therefore, it is less likely for the image forming apparatus A to suffer from the problem that it is reduced in the level of accuracy at which its process cartridge 4 are positioned, by the deformation of the front panel 29. Therefore, it is less likely for the image forming apparatus A to be reduced in image quality because it is reduced in the level of accuracy at which the process cartridges 4 are positioned. Therefore, it is less likely for the image forming apparatus to be reduced in image quality by the aforementioned deformation of the front panel 29.

In the embodiment of the present invention described above, in order to improve the image forming apparatus A in the efficiency with which it can be assembled, the top connective plate 34, left connective plate 35, reinforcement plate 36, right connective plate 37, and bottom connective plate 38, which make up the connective portion for connecting the supporting portion 80 for pivotally supporting the controlling-displaying portion 22, to the main frame of the image forming apparatus A, are independently manufactured from each other. However, the embodiment is not intended to limit the present invention in scope. That is, the present invention is also applicable to an image forming apparatus, the aforementioned members of which are integrally formed as parts of a single connective member. Such application can provide the same effects as those described above.

According to the present invention, it is possible to prevent the problem that as the control portion of an image forming apparatus is pivotally moved, the main frame of the image forming apparatus, which supports photosensitive members, deforms.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-169956 filed on Sep. 11, 2018, which is hereby incorporated by reference herein in its entirety.

What is claimed is:

1. An image forming apparatus comprising:

a photosensitive member;

a frame structure including a first frame supporting said photosensitive member, a second frame provided opposed to said first frame in a rotational axis direction of said photosensitive member and cooperating with said first frame to support said photosensitive member, and a third frame extending in the rotational axis direction and connecting said first frame and said second frame with each other;

an operating portion configured to receive an instruction from a user relating to image formation;

a supporting portion supporting said operating portion so as to be rotatable relative to said frame structure; and a connecting portion connecting said supporting portion with said first frame and said third frame, said connecting portion including a first fixed portion fixed to said third frame, a contact portion contacted with said first frame to restrict movement at least in a first direction while permitting movement in another direction which is different from the first direction, and a second fixed portion fixed to said first frame at a position closer to said first fixed portion than to said contact portion.

2. An apparatus according to claim 1, wherein said supporting portion is disposed at a position between said first fixed portion and said second fixed portion in a direction perpendicular to the rotational axis direction and to a vertical direction.

3. An apparatus according to claim 1, wherein said connecting portion includes a first projected portion projecting downwardly, the first projected portion being adjacent to said contact portion; a second projected portion adjacent to said contact portion on a side opposite from the side having said first projected portion with respect to said contact portion in the rotational axis direction, said second projected portion projecting downwardly, and wherein said contact portion contacts an upper surface of said first frame, and said first frame being interposed between said first projected portion and said second projected portion with gaps in a front-rear direction of said apparatus.

4. An apparatus according to claim 3, wherein the gap between said first projected portion and said first frame and the gap between said second projected portion and said first frame are enough to permit elastic deformation of said connecting portion.

5. An apparatus according to claim 3, further comprising elastic members between said first frame and said first projected portion and between said first frame said second projected portion.

6. An apparatus according to claim 1, wherein said connecting portion includes a third projected portion provided adjacent to said contact portion and projecting in a frontward or rearward direction of said apparatus, and a fourth projected portion projecting in the same direction as said third projected portion and provided adjacent to said contact portion at a position in a side opposite from a side provided with said third projected portion, and wherein said contact portion contacts an upper surface of said first frame, and said first frame being interposed between said third projected portion and said fourth projected portion with gaps in a vertical direction.

7. An apparatus according to claim 6, wherein the gap between said third projected portion and said first frame and the gap between said fourth projected portion and said first frame are enough to permit elastic deformation of said connecting portion.

8. An apparatus according to claim 6, further comprising elastic members between said first frame and said third projected portion and between said first frame said fourth projected portion.

* * * * *